United States Patent [19]

Audeh

[11] 4,397,352

[45] Aug. 9, 1983

[54] IN SITU COMBUSTION OF TAR SANDS WITH INJECTION OF GASES

[75] Inventor: Costandi A. Audeh, Princeton, N.J.

[73] Assignee: Mobil Oil Corporation, New York, N.Y.

[21] Appl. No.: 260,521

[22] Filed: May 4, 1981

Related U.S. Application Data

[63] Continuation-in-part of Ser. No. 203,028, Nov. 3, 1980, abandoned.

[51] Int. Cl.[3] ..... E21B 43/243

[52] U.S. Cl. ..... 166/260

[58] Field of Search ..... 166/256, 257, 259, 260, 166/261, 272

[56] References Cited

U.S. PATENT DOCUMENTS

| | | | |
|---|---|---|---|
| 2,880,803 | 4/1959 | Parker | 166/260 X |
| 2,906,340 | 9/1959 | Herzog | 166/260 |
| 3,064,728 | 11/1962 | Gould | 166/261 |
| 3,093,191 | 6/1963 | Glass | 166/261 |
| 3,179,167 | 4/1965 | Strange et al. | 166/261 X |
| 3,221,812 | 12/1965 | Prats | 166/260 X |
| 3,280,910 | 10/1966 | Crider | 166/256 |
| 3,361,201 | 1/1968 | Howard | 166/261 X |
| 3,872,924 | 3/1975 | Clampitt | 166/261 |
| 4,027,917 | 6/1977 | Bartel et al. | 166/260 |
| 4,127,171 | 11/1978 | Allen | 166/261 X |
| 4,130,164 | 12/1978 | Datta | 166/261 X |
| 4,186,800 | 2/1980 | Allen | 166/256 |
| 4,241,790 | 12/1980 | Magnie | 166/260 |

*Primary Examiner*—Stephen J. Novosad
*Assistant Examiner*—George A. Suchfield
*Attorney, Agent, or Firm*—Charles A. Huggett; James F. Powers, Jr.; Lawrence O. Miller

[57] ABSTRACT

In-situ combustion of heavy subterranean oil formations, e.g., tar sands, is improved by introducing into the oil formation a stream of a combustible gas. The stream of gas may contain a small proportion of hydrocarbons condensable at temperature and pressure conditions of the formation. The improvement is applicable to both forward and reverse in-situ combustion processes.

11 Claims, No Drawings

IN SITU COMBUSTION OF TAR SANDS WITH INJECTION OF GASES

CROSS-REFERENCE TO RELATED APPLICATION

This application is a continuation-in-part of a copending U.S. application, Ser. No. 203,028, filed Nov. 3, 1980, now abandoned.

BACKGROUND OF THE INVENTION

1. Field of the Invention

This invention relates to a method of recovery of heavy, viscous, normally non-flowing hydrocarbons from subterranean formations of petroliferous deposits. More particularly, this invention relates to an improved in-situ combustion method of recovering valuable hydrocarbon products from subterranean petroliferous deposits.

2. Background of the Invention

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands deposits found in Northern Alberta, Canada, and in the Midwest States of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974 it was estimated that not more than about 10% of the then estimated 250 billion barrels of synthetic crude equivalent of deposits in Alberta, Canada was recoverable by the then available mining technologies. (See SYNTHETIC FUELS, March 1974, Pages 3-1 through 3-14). The remaining about 90% of the deposits must be recovered by various in-situ techniques such as electrical resistance heating, steam injection and in-situ forward and reverse combustion. In addition to tar sands, heavy, viscous crudes and crudes from partially depleted reservoirs are also recoverable by in-situ production techniques.

While details of operating of all of such in-situ techniques vary, a common objective thereof is to lower the viscosity of the hydrocarbon deposits to the point where they can be pumped to the surface of the formation with equipment normally available at the formation site.

Of the aforementioned in-situ recovery methods, in-situ combustion (both forward and reverse) appears to be the most promising method of economically recovering large amounts of hydrocarbon deposits with currently available technology. The attractiveness of the in-situ combustion methods arises primarily from the fact that it requires relatively little energy necessary for sustaining combustion of the hydrocarbon deposits. In contradistinction, other in-situ techniques, such as electrical resistance heating and steam injection require considerable amounts of energy, e.g., to heat the steam at the surface before it is injected into the petroliferous formation.

Conventional in-situ combustion involves drilling of at least two substantially vertical wells into the formation, the wells being separated by a horizontal distance within the formation. One of the wells is designated an injection well, and the other a production well. The recovery of hydrocarbons is accomplished by raising the temperature around a bore hole to the combustion temperature of the petroliferous deposit with some type of a conventional down hole heater/burner apparatus, and then supporting the combustion by injecting an oxidizing gas, e.g., oxygen or air into the formation. There are two basic processes of in-situ combustion, viz., forward and reverse combustion. Forward combustion is initiated at the oxidant injection well and the combustion front propagates toward the production well. Reverse combustion is initiated at the production well and the combustion front propagates toward the oxidant injection well. Hydrocarbon vapors produced during the combustion process are recovered at the surface of the formation and stored in appropriate containers. The combustion is conducted at a temperature not to exceed 1500° F. for about 12 months until the viscosity of oil deposits is reduced to 700–800 cp, generally considered necessary for pumping the oil to the surface of the formation. Further details of forward and reverse in-situ combustion techniques are set forth in SYNTHETIC FUELS, March 1974, pages 3–4 through 3–14, and in THE TAR SANDS OF CANADA by F. W. Camp, pages 27–34, Cameron Engineers, Inc., Denver, Colorado, 2nd Edition (1974), the entire contents of which are incorporated herein by reference. Modified in-situ combustion techniques using a combination of oxygen and other chemical substances are also known in the art. For example, Heilman et al., U.S. Pat. No. 2,718,263 uses a mixture of oxygen-containing gas and fuel to generate heat in the formation, and Elzinga, U.S. Pat. No. 3,087,541, injects fuel into the formation only after the combustion has started. Both of these modified in-situ prior art combustion processes use fuels injected externally into the formation either simultaneously with oxygen or after the injection of oxygen to control the direction of speed of propagation of the combustion front.

However, heretofore practiced in-situ combustion techniques have resulted in a relatively low rate of recovery of available hydrocarbons from subterranean petroliferous formations. For example, the rates of recovery have been reported to be less than about 50% of the total deposits of tar sands, e.g., SYNTHETIC FUELS, March 1974, pages 3–4 through 3–14.

Accordingly, it is a primary object of this invention to provide an improvement in the prior art known in-situ combustion processes.

It is an additional object of this invention to provide a process for in-situ combustion of petroliferous deposits which results in improved rates of recovery of hydrocarbon products.

Additional objects will become apparent to those skilled in the art from the study of the disclosure and of the appended claims.

SUMMARY OF THE INVENTION

These and other objects have been attained by introducing into the subterranean petroliferous formation, prior to the commencement of a conventional in-situ combustion process, a combustible gas. The gas is introduced into the formation through wells drilled to sufficient depths to reach the bottom or near the bottom of the formation. The combustible gas may optionally contain a relatively small proportion of condensable compounds which aid in the combustion of the hydrocarbons of the formation.

DETAILED DESCRIPTION OF THE INVENTION

A subterranean petroliferous formation which can be subjected to the process of the present invention is any formation containing sources of hydrocarbons difficult to recover by conventional techniques. Suitable formations are tar sand deposits, deposits of heavy petroleum crudes (having a density of 0.95–1.05 g/cm$^3$) and deposits of lighter crudes depleted to some extent by conventional techniques. The typical density of such partially depleted formations is 0.80–1.05 g/cm$^3$.

The combustible gas introduced into the formation is any readily available gas that is soluble to some degree in the hydrocarbons of the formation and is preferably noncondensable at the temperature and pressure of the formation, e.g., carbon monoxide (CO), ammonia ($NH_3$), hydrogen ($H_2$), hydrogen sulfide ($H_2S$), and hydrocarbons. The condensation point of the combustible gas is generally −255° C. to −10° C., preferably −192° C. to −10° C. at the pressure of one atmosphere. In the case of hydrocarbons, the condensation point thereof is preferably 100° K. to 230° K. (−173° C. to −43° C.) and most preferably 110° K. to 184° K. (−163° C. to −89° C.) under ambient pressure of about 1 atmosphere. Suitable hydrocarbon gas is natural gas, and low boiling alkanes and alkenes of $C_1$ to $C_3$, e.g., methane, ethane, ethene, propane, propene, preferably methane, ethane and natural gas and most preferably natural gas. When the combustible gas is not a hydrocarbon, the gas should have a measurable solubility (at least about 0.1% by weight at the pressure of the formation) in the petroliferous deposit and its boiling point should be less than −10° C., preferably less than −20° C.

It is to be understood that ambient pressure of about 1 atmosphere does not necessarily designate pressure of exactly one (1) atmosphere, insofar as the ambient pressure may vary depending on the altitude of the petroliferous formation. Thus, the term "ambient pressure" as used herein encompasses pressures of 0.95 atmospheres to 1.05 atmospheres.

The gas introduced into the formation can either be a substantially pure homogeneous gas having the aforementioned properties, or it can be a mixture of any of the gases suitable for use with the process of the present invention so long as the gases in the mixture do not react with each other with detrimental effects to the process. For example, it is well known that ammonia and hydrogen sulfide gases easily react to form ammonium hydrosulfide, a solid which would tend to clog up process lines and passages in the formation. Accordingly, it will be obvious to those skilled in the art that any combination of the aforementioned gases must be avoided. It will be apparent to those skilled in the art, that if a mixture of gases is used, the relative proportion of each individual gas must be such that the properties of the mixture fall within the limits specified above for a pure homogeneous gas.

The gas is introduced into the petroliferous formation either by means of bore holes drilled specifically for that purpose or through injection or production wells. The well through which the gas is introduced is drilled to reach the bottom of the formation or near the bottom thereof. In any event, the point of entry of the gas into the formation may not be more than 0% to 50% of the height of the formation, preferably 1% to 40%, and most preferably 3% to 25% of the height of the formation, measured from the bottom thereof. In this connection, the height of the petroliferous formation is defined as the total thickness of the formation, measured from a beginning point below the surface of the earth where the amount of petroliferous materials in the formation is at least 80%, preferably 100%, to the point above said beginning point of the formation wherein the relative amount of petroliferous material in the formation is at least 95%, preferably 100%.

The rate of introduction of the gas into the formation will vary, depending on the type of the gas used in a particular embodiment and on the formation wherein the process is practiced. Generally speaking, the rate of introduction of the gas and the time required for the introduction thereof into the formation will be such that the injection will continue until the formation contains at least 30 cu ft. of gas per barrel of oil equivalents present in the formation, preferably 30 to 1000 cu ft. of gas per barrel of oil equivalents present in the formation. Most preferably, the formation will be relatively substantially saturated with the gas injected therein. In this connection, a point of relative saturation of the formation with the gas is defined as the point at which the formation cannot absorb appreciable additional quantities of gas beyond those which have already been absorbed.

The pressure under which the combustible gas is introduced into the formation will be determined by the depth of the formation below the surface of the earth and by the existing pressure at that depth. For example, in the case of a tar sand deposit and for a relatively light hydrocarbon gas, the gas is introduced under a pressure of 20 atm to 100 atm, preferably 60 atm to 80 atm, and most preferably 65 atm to 70 atm, and at a temperature of −40° C. to 100° C., preferably 0° C. to 60° C., and most preferably 25° C. to 35° C.

The combustible gas used in the process is supplied from any convenient source, e.g., brought to and stored at the site in conventional containers. Some combustible gases may be available at the site of the formation from other related or not related operations. For example, in Canada, $H_2S$ is produced near the tar sands formations as a byproduct of closely adjacent recovery and processing operations. The $H_2S$ produced in this manner can be conveniently delivered (e.g., through a direct pipeline) to the tar sands formation and used as the combustible gas in the present process.

In an alternative embodiment, the combustible gas may contain a small proportion (1% to 10% by volume) of compounds which condense at the temperature and pressure conditions of the formation. The condensed compounds (e.g., methylamine, ethylamine, t-butylamine and hydrocarbons) have a condensation point of not more than 100° C. at ambient pressure and they are dissolved in the petroliferous deposits facilitating the combustion of the latter during the subsequent in-situ combustion. If the condensable compounds used for such purpose are hydrocarbons, they must have a condensation point of at most 100° C. under ambient pressure conditions of about one atmosphere. Suitable condensable hydrocarbons for such purpose are: all hydrocarbon of $C_4$ to $C_7$, such as alkanes, alkenes and aromatics, e.g., n-butane, isobutane, n-pentane, isopentane, hexane, all of its isomers and heptane and all of its isomers, benzene, and toluene, preferably normal pentane and isopentane, hexane, heptane and all of the isomers thereof.

The amount of condensable compounds present in the combustible gas injected into the formation is 1% to 10%, preferably 2% to 8%, and most preferably 3% to 5% by volume. The condensable compounds dissolve relatively easily in the formation, thereby aiding in the combustion thereof when in-situ combustion is initiated. When the condensable compounds are hydrocarbons, their viscosity should be 0.01 centipoise (cp) to 0.5 centipoise at 40° C. Preferably, the viscosity should be 0.05 centipoise to 0.3 centipoise, and most preferably 0.10 centipoise to 0.15 centipoise at 40° C. The density of the condensable hydrocarbons should be 0.6 to 0.75 g/cm$^3$, preferably 0.62 to 0.67 g/cm$^3$, most preferably 0.65 g/cm$^3$.

The relatively easily condensable hydrocarbons present in the gaseous stream can either comprise a single homogeneous hydrocarbon substance encompassed by any one of the generic groups enumerated above, or they can be a mixture of any of such substances, so long as the relative proportions of the individual components of such mixtures are such that the condensation point, the viscosity, the density and other properties of the mixture fall within the range of the respective properties of the relatively easily condensable hydrocarbons specified above.

After the injection of the combustible gas, either with or without condensable compounds, is completed, the in-situ combustion proceeds in the usual manner, i.e., the temperature of the formation is brought to or near the combustion temperature and oxygen or air is injected into the formation in a conventional manner as described in S. M. Farouq Ali, *A Current Appraisal of In-Situ Combustion Field Tests,* THE JOURNAL OF PETROLEUM TECHNOLOGY, pp. 477–486, (April, 1972), the entire contents of which are incorporated herein by reference.

Some combustible gases, used in the process of this invention, have a relatively low autoignition temperature. For example, the autoignition temperature of hydrogen sulfide ($H_2S$) is about 260° C. Accordingly, ignition of the subterranean petroliferous formation can be initiated at relatively low formation temperatures.

In any event, once the combustion of the petroliferous material has begun, the combustible gas previously introduced into the formation and which preferably saturates the formation, aids in the combustion, thereby markedly accelerating the entire combustion process and increasing the yield of recoverable hydrocarbons.

The following examples illustrate specific non-limiting embodiments of the invention. All temperatures are in degrees C., all pressures in atmospheres, and all percent proportions in percent by volume, unless otherwise indicated.

EXAMPLE 1

A sample of tar sand containing 14% by weight of petroliferous material is subjected to a laboratory simulated in-situ combustion test. Air is then injected and the tar sand is heated so as to initiate combustion. Difficulty is experienced in the ignition and in sustaining the combustion of the tar sand. The difficulty on initiating combustion is due, it is believed, to the lack of volatiles in the oil deposited on the sand.

EXAMPLE 2

In contrast, the experiment of Example 1 is repeated, but this time, methane is injected under pressure until the amount absorbed is equivalent to 300 cu ft/bbl of oil contained in the sand. After this injection is completed, the above described procedure, air injection followed by heating, is carried out. The tar sand is ignited, the flame sustained and the oil is collected.

EXAMPLE 3

Example 2 is repeated with a natural gas containing 5% $C_2$ and heavier hydrocarbons, of which the condensables comprise 2–3%. Similarly, the tar sand is ignited, the flame sustained and oil is collected.

It will be apparent to those skilled in the art that the above examples can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. In a process for the recovery of petroliferous products from a subterranean formation including tar sand deposits by in-situ combustion, the improvement comprising introducing into said subterranean formation, prior to the commencement of the combustion, a stream of a combustible gas selected from the group consisting of a relatively light hydrocarbon gas having a condensation point of −173° C. to −43° C. at a pressure of one atmosphere and hydrogen sulfide, said combustible gas introduced in an amount to substantially saturate the formation with said gas.

2. A process according to claim 1 wherein said stream of combustible gas is introduced into said subterranean formation at the pressure of 20 atmospheres to 100 atmospheres.

3. A process according to claim 2 wherein said combustible gas contains 1% to 10% by volume of a condensable compound having a condensation point of not more than 100° C. at ambient pressure.

4. A process according to claim 3 wherein said condensable compound is normal butane, iso-butane, normal pentane, isopentane, hexane, heptane, isomers thereof, or mixtures thereof, methylamine, t-butylamine, ethylamine and mixtures thereof.

5. A process according to claim 1 wherein said condensation point of said relatively light hydrocarbon gas is −163° C. to −43° C. at a pressure of one atmosphere.

6. A process according to claim 5 wherein said relatively light hydrocarbon gas is introduced into said subterranean formation at the pressure of about 60 atmospheres to about 80 atmospheres.

7. A process according to claim 6 wherein said stream of relatively light hydrocarbon gas is methane, ethane, propane, natural gas or mixtures thereof.

8. A process according to claim 7 wherein said stream of relatively light hydrocarbon gas contains 1% to 10% by volume of a condensable hydrocarbon gas having a condensation point of not more than 100° C. at a pressure of one atmosphere.

9. A process according to claim 8 wherein said condensable hydrocarbon gas is normal butane, iso-butane, normal pentane, isopentane, hexane, heptane, isomers thereof, or mixtures thereof.

10. A process according to claim 1 wherein said combustible gas is hydrogen sulfide.

11. The method of claim 1 wherein said combustible gas is a relatively light hydrocarbon gas.

* * * * *